United States Patent [19]

Lusk et al.

[11] Patent Number: 4,666,659

[45] Date of Patent: May 19, 1987

[54] SHIPPING AND STORAGE CONTAINER FOR SPENT NUCLEAR FUEL

[75] Inventors: Elmer C. Lusk; John L. Ridihalgh, both of Columbus, Ohio

[73] Assignee: Mitsubishi Heavy Industries, Ltd., Tokyo, Japan

[21] Appl. No.: 545,228

[22] Filed: Oct. 25, 1983

[51] Int. Cl.[4] ..... G21F 5/00

[52] U.S. Cl. ..... 376/272; 250/507.1; 29/400 N; 29/723; 29/522 R

[58] Field of Search ..... 376/272, 287; 250/506.1, 507.1, 515.1, 518.1; 252/633; 29/400 N, 723, 525, 522 R

[56] References Cited

U.S. PATENT DOCUMENTS

| | | | |
|---|---|---|---|
| 3,414,727 | 12/1968 | Bonilla | 376/272 X |
| 3,731,102 | 5/1973 | Peterson | 250/108 R |
| 3,886,368 | 5/1975 | Rollins et al. | 376/272 X |
| 3,962,587 | 6/1976 | Duframe et al. | 376/272 X |
| 4,006,362 | 2/1977 | Mollon et al. | 376/272 |
| 4,288,699 | 9/1981 | van de Vlis et al. | 250/507 |
| 4,292,528 | 9/1981 | Shaffer et al. | 250/506.1 |
| 4,305,787 | 12/1981 | Rivacoba | 376/272 |
| 4,336,460 | 6/1982 | Best et al. | 250/506 |
| 4,399,366 | 8/1983 | Bucholz | 376/272 X |

*Primary Examiner*—Teddy S. Gron
*Assistant Examiner*—Virginia B. Caress
*Attorney, Agent, or Firm*—Wood, Herron & Evans

[57] ABSTRACT

A shipping and transport cask for spent nuclear fuel elements. The cask includes a cylindrical cask body having an outer shell and a concentric inner tube. Four quadrant baskets are mounted within the inner tube. Each quadrant basket includes radial and peripheral walls of high thermal conductivity material. A plurality of fuel element-receiving modules and an inner quadrant heat conducting member are mounted within the quadrant baskets. The peripheral walls of the quadrant baskets are held firmly against the inner wall of the body by shims inserted between the radial walls of adjacent quadrant baskets. During assembly, the quadrant baskets are initially forced outwardly against the inner wall by means of expandable spreaders. The cask also includes removable trunnions and primary and secondary external fluid chambers filled with a neutron-attenuating fluid. A siphon tube interconnects the chambers so that the primary chamber which surrounds the major portion of the cask remains filled despite changes in temperature of the fluid.

19 Claims, 14 Drawing Figures

SHIPPING AND STORAGE CONTAINER FOR SPENT NUCLEAR FUEL

BACKGROUND OF THE INVENTION

This invention is directed to containers and is particularly directed to a shipping and storage container for spent fuel elements of nuclear reactors.

It is the practice in the operation of nuclear reactors to change approximately one-third of the nuclear fuel elements of a reactor each year. These fuel elements comprise a subassembly, or bundle, of fuel rods. The fuel elements of a boiling water reactor (BWR) are normally 5½" square by 176" long. The fuel elements of a pressurized water reactor (PWR) are approximately 8½" square and 164" long.

When removed from the reactor, these spent fuel assembles are still highly radioactive. Consequently, care must be taken to ensure that the container in which the elements are stored and shipped does not permit escape of excessive radiation. Moreover, the spent fuel elements generate heat incident to their radioactive decay. For example, a so-called "5-year cool down" PWR fuel element generates 100 kilowatts of heat when removed, 12 kilowatts 90 days after removal and one kilowatt after five years. Similarly, a BWR fuel element generates 50 kilowatts when removed, six kilowatts 90 days after removal, and is still generating one-half kilowatt five years after removal. Consequently, the cask must provide for effective heat dissipation to prevent the fuel assemblies or portions of the cask from deteriorating in any way that could cause escape of radioactive or toxic substances.

Another requirement of spent fuel casks is that they be rugged and able to withstand the jarring and bumping incident to transportation by truck or rail without structural damage which might permit the escape of radioactive gases or other contaminants. Such casks must also meet the stringent requirements of the 10 C.F.R. part 71 specified accident criteria.

SUMMARY OF THE INVENTION

It is the principal object of the present invention to provide a storage and shipping cask which can hold a large number of "five-year cool down" spent nuclear fuel elements, e.g., 52 BWR fuel elements or 24 PWR fuel elements. This is double the capacity of any prior art storage and shipping cask. The present cask provides effective protection against the escape of excessive radiation and is sufficiently rugged and durable to withstand shocks incident to handling and transportation without suffering structural damage.

It is an equally important object of the present invention to provide a shipping and storage container for spent nuclear fuel having a high degree of thermal transfer efficiency so that heat generated by the large number of stored fuel elements is distributed through the container to the cask outer walls and dissipated without the temperature at any point rising to a level which would cause deterioration of a fuel element or damage to the cask structure.

A still further object of the present invention is to provide a storage and shipping cask including passive means for maintaining a chamber surrounding the cask filled with neutron-absorbing fluid despite expansion and contraction of the fluid due to temperature changes.

It is another object of the present invention to provide a storage and shipping cask which can be stored in either a horizontal or vertical orientation.

It is another object of the present invention to provide a storage and shipping cask in which the final closure is welded with the closure being configurated so that the cask can be reopened and the closure reused.

It is a still further object of the present invention to provide a shipping and storage cask including removable trunnions which facilitate handling of the cask by equipment of the type normally available to electric power utilities, which trunnions are removed during shipment to prevent damage to the cask in the event that it is dropped on the area of a trunnion. The provision of removable trunnions is further advantageous because the trunnions can be reutilized on other casks. Moreover, once the trunnions are removed, unauthorized handling of the cask is prevented.

A cask constructed in accordance with the principles of the present invention includes a tubular body having inner and outer walls separated by lead shielding. A plurality of basket members, preferably four quadrant baskets are mounted within the cylindrical chamber provided by the inner wall. Each of these quadrant baskets incorporates a quarter-section of a circumferential wall; each also includes two radial walls of high-conductivity material. A plurality of individual fuel element-receiving modules, preferably of open rectangular or round cross-section, are mounted in each quadrant basket. The walls of these modules are formed of metal encased, neutron-absorbing material. Walls of adjacent modules are in firm contact with one another and the walls of modules adjacent the radial walls of the quadrant baskets are in firm contact with those walls. Each quadrant basket further includes an internal quadrantal wall of high-conductivity material in engagement with other module walls.

The radial walls and inner quadrantal walls terminate in flanges which have a substantial overlap with the circumferential wall. These flanges are mechanically joined to the circumferential wall as by means of rivets or threaded fasteners to provide optimum heat transfer across the lapped areas. The circumferential wall is in turn forced into firm contact with the inner wall of the cask body by means of wedges interposed between the opposing walls of adjacent quadrant baskets. Thus, there is a high efficiency heat transfer from the individual storage modules through the radial walls and quadrantal walls to the circumferential wall and to the inner wall of the cask body. This heat is then transferred through the cask body to the outer shell and is dissipated to the surrounding atmosphere by radiation and convection modes of heat transfer.

The present invention contemplates a novel method of assembling casks to ensure effective heat transfer from the quadrant baskets to the inner wall of the cask body. More specifically, in accordance with the present invention, the cask body is prefabricated as are the four quandrant baskets. The four quadrant baskets are then inserted into a cylindrical chamber formed within the inner wall of the cask body. Thereafter, a flat separator member which extends substantially the length of the quadrantal baskets is inserted between the opposed walls of two adjacent baskets.

The separator member is formed of two sheets, e.g., stainless steel sheets, which are joined around their periphery and are provided with a fluid fitting. After the separator member has been inserted, a fluid, such as compressed air, is introduced into the separator to cause it to expand, forcing the quadrant baskets tightly against the surrounding inner wall. After the quadrant baskets have been forced against the inner wall by the separator member, it is deflated and removed. A wedge assembly is then forced between the previously separated walls of the two quadrant baskets to hold the baskets in contact with the inner wall. This process is repeated until all of the quadrant baskets have been forced outwardly into contact with the surrounding cask wall.

The cask is closed by means of a first cover member which fits inside the outer shell and spans the inner tube to close the cask cavity. This inner cover has O-ring seals and is bolted in place. A second, or outer cover, fits across the inner cover and engages the end of the outer shell. Both the outer cover and outer shell are provided with outwardly extending mating flanges which abut one another when the cover is in place. These flanges are welded together by a circumferential bead to provide a second seal for the cask. The outer cover can be removed by cutting the flanges just inside the weld. Sufficient portions of both flanges remain so that the cover can be reused and resealed up to three times by again welding around the periphery of the flanges. Another advantage of providing a welded outer cover is that the cask can be filled with a gas having a high thermal conductivity and the gas will not escape as it would past other types of seals.

In accordance with the present invention, an external neutron shield is provided in the form of a circumferential jacket which surrounds the outer shell. This jacket forms a primary fluid chamber which is filled with a suitable neutron-absorbing material, such as a mixture of either pure or borated water and ethylene glycol. The jacket also forms a smaller secondary fluid chamber adjacent one end of the cask. The primary and secondary fluid chambers are interconnected by a siphon tube which communicates with the secondary chamber and a diametrically opposite portion of the primary chamber adjacent the opposite end of the cask. By virtue of this arrangement, the primary chamber remains filled with neutron-absorbing fluid irrespective of any expansion or contraction of the fluid due to any temperature change.

BRIEF DESCRIPTION OF THE DRAWINGS

These and other objects and advantages of the present invention will be more readily apparent from a further consideration of the following detailed description of the drawings illustrating a preferred and alternative embodiments of the invention.

In the drawings.

DESCRIPTION OF A PREFERRED EMBODIMENT

Figure 1:
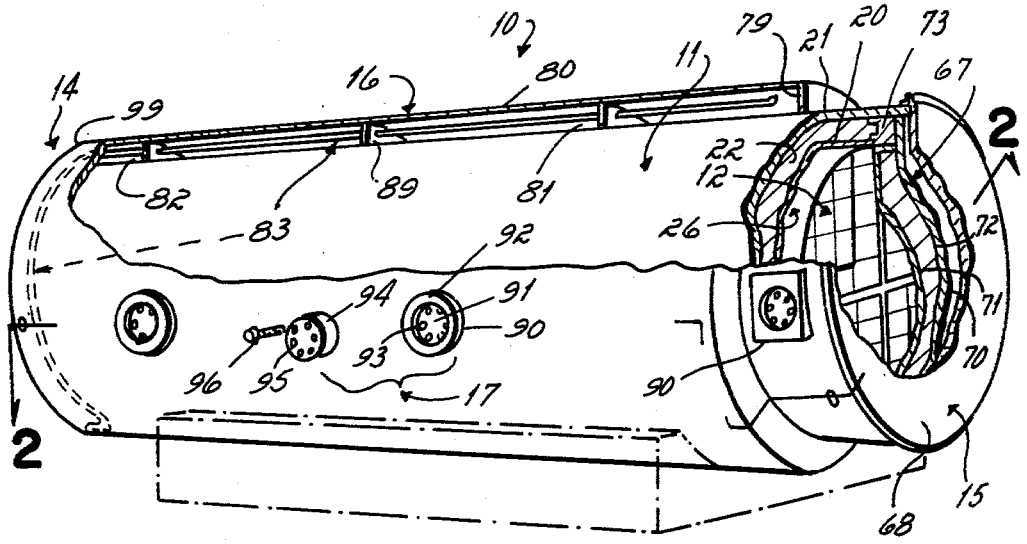
FIG. 1 is a perspective view of a storage and shipping cask of the present invention.

A preferred form of storage and shipping cask 10 constructed in accordance with the principles of the present invention is shown in FIG. 1. As there shown, the cask includes a generally cylindrical body assembly 11 having a central chamber which houses four quadrant baskets 12. The quadrant baskets carry a plurality of generally rectangular spent fuel storage modules 13 adapted to receive bundles of spent fuel storage rods.

Figure 2:
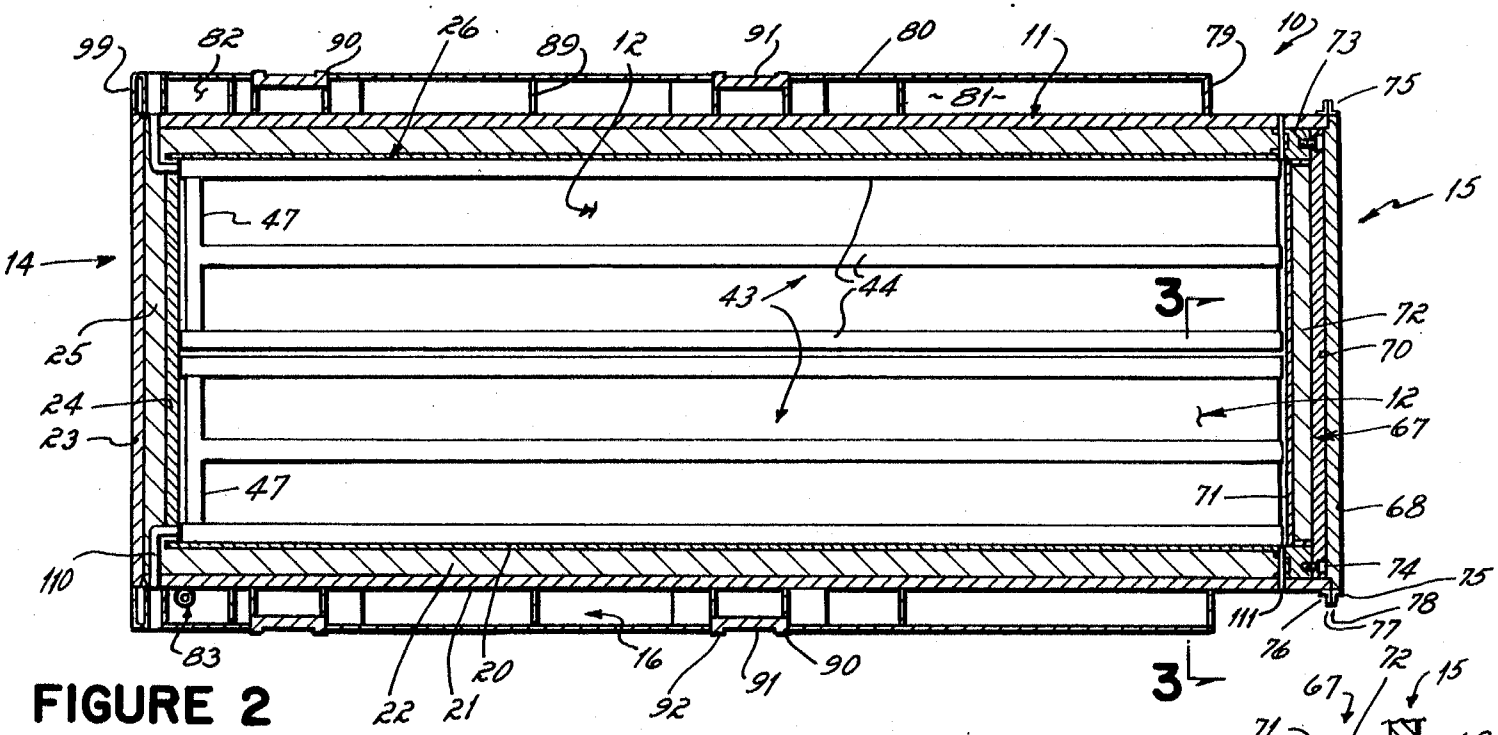
FIG. 2 is a cross-sectional view taken along line 2—2 of FIG. 1.

As shown in FIG. 2, the cask includes a permanently closed end 14 and a cover 15 which encloses the other end. The permanently closed end will hereinafter be referred to as the "bottom". An annular neutron shield 16 surrounds the cask body. This shield comprises two chambers which contain a neutron-absorbing material, such as a borated water, ethylene glycol mixture and, as explained below, are interconnected by a siphon tube so that the main shielding chamber surrounding the cask body remains full over a wide range of operating temperatures.

Figure 12:
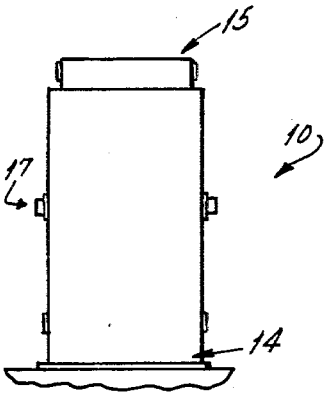
FIG. 12 is a plan view showing the present cask supported with its axis in a vertical position.

The cask 10 is approximately 16' long and 8' in diameter. It is adapted to be stored in a horizontal position as illustrated in FIG. 1 or in a vertical position in which the bottom end is supported on a horizontal surface as illustrated in FIG. 12. The cask is adapted to be handled and shifted from position-to-position by means of removable trunnions 17. Two sets of trunnions are positioned to be engaged by a suitable yoke structure and lifting mechanism to lift the cask onto a transport vehicle or to remove it from such a vehicle when desired. One trunnion of a set is illustrated removed from its mount in FIG. 1, while a plurality of mount positions are shown empty.

The details of construction of the cask are best shown in FIGS. 1–11. As there shown, the cask body assembly 11 comprises an inner tubular member, or shell, 20, preferably formed of 1" stainless steel plate, and an outer shell 21 preferably formed of 2" stainless steel plate and disposed in concentrically spaced relationship with inner shell 20. An annular lead shield 22 fills the space between the inner and outer tubular members 20 and 21 and together with these members forms a gamma ray shield.

The bottom closure 14 comprises an outer plate 23, preferably of 2" stainless steel, which is welded to the bottom edge of outer shell 21. An inner bottom plate 24, preferably of 2" stainless steel, is welded to the lower end of inner tubular member 20. A lead body 25 fills the space between plates 23 and 24 to provide shielding for the bottom of the cask. Alternatively, the bottom closure can be a steel plate of approximately 9" thickness.

The inner tubular member 21 and bottom wall 20 define a cylindrical chamber 26 in the cask. This chamber receives four quadrant baskets 12. It is to be understood that the quadrant baskets are identical in construction so that the construction of only one of these baskets will be explained in detail. It is also to be understood that a different number of basket members can be employed if desired.

Each quadrant basket 12 extends for substantially the length of the chamber 26, i.e., from near bottom wall 24 to the inner wall of cover 15. Quadrant basket 12 comprises a circumferential wall 27 and two radial walls 28 and 30. The radial walls are preferably formed from a single piece of metal having a high thermal conductivity, such as copper plate approximately ¼" in thickness. The peripheral wall 27 is preferably formed of the same copper plate. The radial walls 28 and 30 are disposed at right angles to one another and extend outwardly to areas adjacent to the edges of peripheral wall 27. Each of the radial walls 28 and 30 is provided with a flange 31 and 32, respectively, which overlaps or abuts the inner surface of peripheral wall 27 for a substantial distance, for example, of the order of 2" or more.

Figure 6:
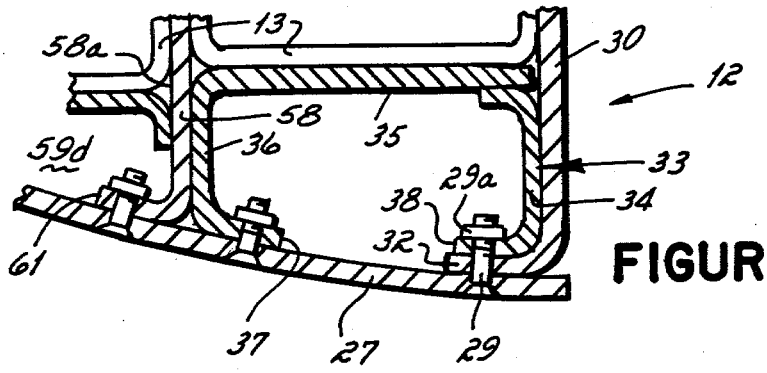
FIG. 6 is an enlarged cross-sectional view taken of the encircled area "6" of FIG. 3.
Figure 7:
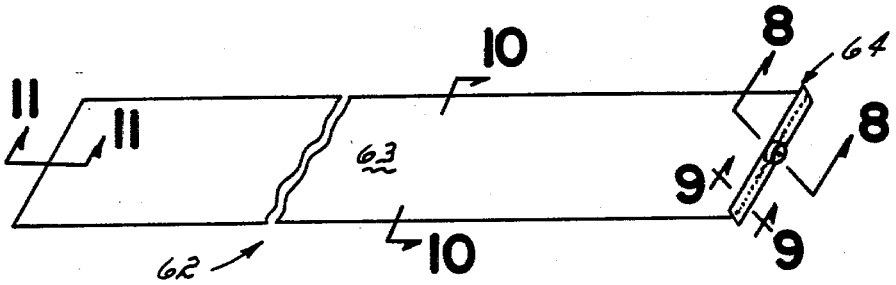
FIG. 7 is a perspective view of a spreader member utilized in the construction of the present cask.

A stainless steel spacer member 33 is disposed inwardly of flange 32. The spacer member is preferably formed of ¼" stainless steel plate and is configurated to form one wall 34 which lies along radial wall 30, a wall 35 which abuts the adjacent storage module 13, a wall 36 parallel to wall 34, a flange 37 which abuts the inner surface of peripheral wall 27, and a flange 38 which overlies flange 32. Peripheral wall 27, flange 32 of radial wall 30, and flange 38 are connected together by a plurality of flat head rivets (not shown), or threaded fasteners 29, which extend inwardly through peripheral wall 27, flange 32 of radial wall 30 and the adjacent flange 38 of spacer 33. As shown in FIG. 6, fastener 29 is flat-headed and resides in a countersunk opening in peripheral wall 27 so that the head of the fastener lies flush with the outer surface of that wall. If a rivet is employed, its head is flat and is flush with the outer surface of peripheral wall 27. When a fastener is employed, it threadably engages a nut **29*a* in contact with flange 38**.

Similarly, the flange 31 of radial wall 28 abuts the inner surface of peripheral wall 27 over a substantial width preferably in excess of 2". A stainless steel spacer member 33 includes a flange 38 abutting the inner surface of flange 31, a wall 34 in abutment with wall 28, a wall 35 in abutment with adjacent storage module 13, a wall 56 parallel to wall 34 and a flange 37 in abutment with the inner surface of peripheral wall 27.

The peripheral wall 27 is connected to flange 31 and flange 38 by means of flat-headed rivets or threaded fasteners in the same manner as the peripheral wall 27 is secured to flanges 32 and 38.

When the quadrant baskets 12 are finally assembled in chamber 26, the entire peripheral wall 27 of each of the quadrant baskets firmly contacts the abutting inner surface of inner shell 20 providing optimum thermal conductivity from the quadrant baskets to the inner shell 20 and the body of the cask.

Figure 3:
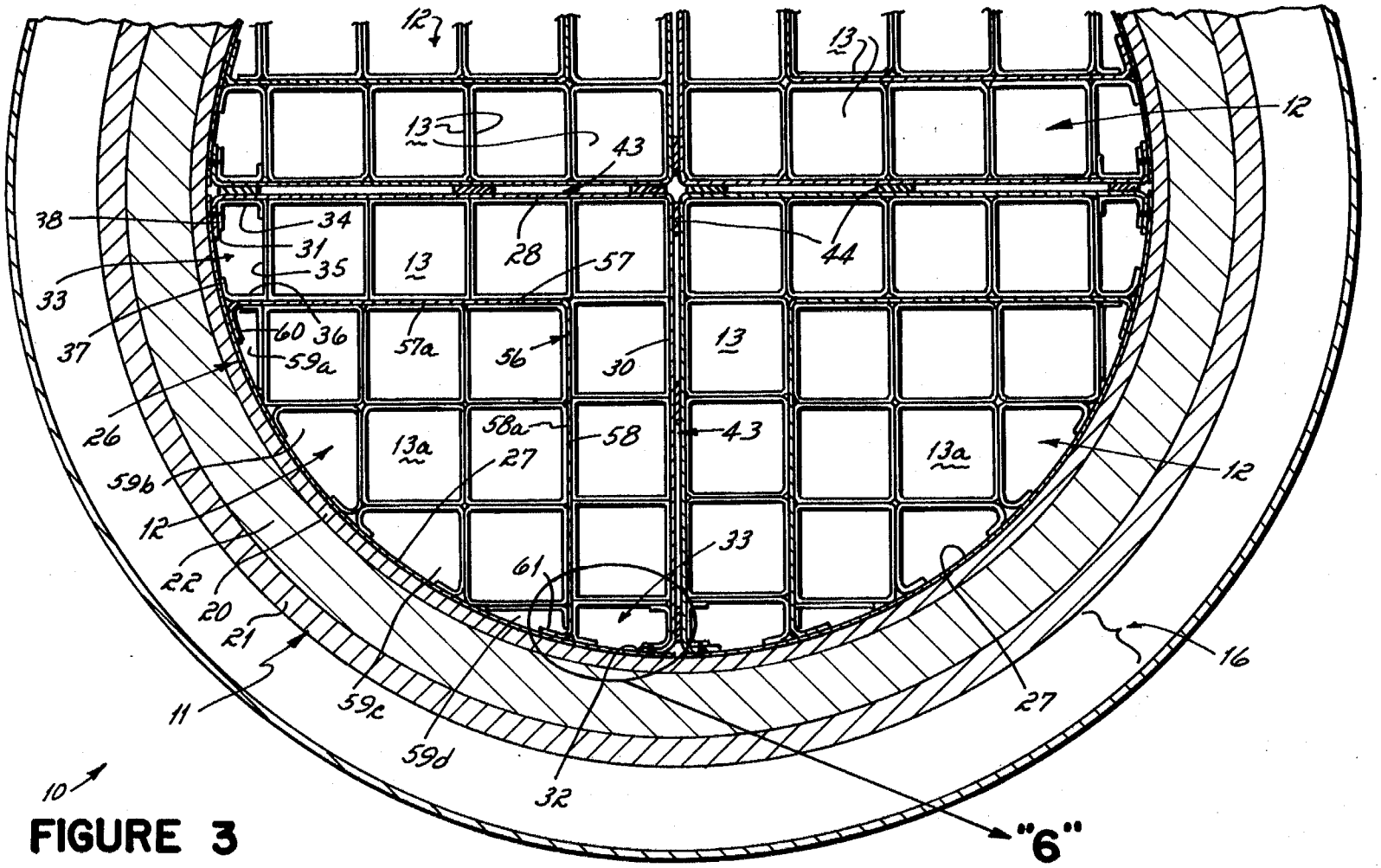
FIG. 3 is a cross-sectional view taken along line 3—3 of FIG. 2.

The quadrant baskets 12 are held in firm contact with the inner shell 20 by means of shims. One preferred form of assembly 43 is best shown in FIGS. 2 and 3. As shown in FIG. 2, each shim assembly comprises three elongated shim strips 44. The shims extend the length of chamber 26 and are of generally rectangular cross-section.

In addition to the individual shims 44, the shim assembly includes transverse members 47 interconnecting the individual shim members and effective to hold the bottom portions of the individual shims spaced apart so that the individual shim strips remain in parallel relationship.

Figure 5:
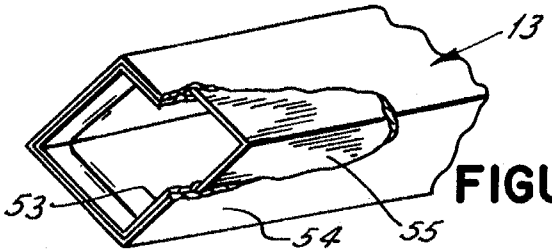
FIG. 5 is a perspective view, partially broken away, of a storage module.

In addition to the elements thus described, each quadrant basket comprises a plurality of storage modules 13. Each storage module 13 is adapted to receive a spent fuel element and to serve as a neutron absorber. One preferred form of storage module is illustrated in FIG. 5. These storage modules are produced by Brooks & Perkins and are described in detail in Mollon et al U.S. Pat. No. 4,006,362. For storage of BWR elements, the storage modules are approximately 6" square and approximately 176" long.

Specifically, each of the fuel storage modules 13 comprises concentric inner and outer square stainless steel "shrouds" 53 and 54 which integrally encapsulate Boral neutron absorber plates 55. The Boral absorber plates comprise a dispersion of boron carbide in aluminum. These panels are disclosed in Rockwell et al U.S. Pat. No. 2,727,996.

In the preferred embodiment illustrated, seven of the storage modules 13 are arranged in two rows which are disposed at right angles to one another and which lie inwardly adjacent quadrant walls 28 and 30. The outer shrouds of modules 13 in these rows are in firm contact with the adjacent module and with walls 28 and 30. An inner quadrantal heat transfer member 56 is disposed inwardly adjacent to these two rows of storage modules. Member 56 is in firm contact with the outer shrouds of the adjacent modules 13. Member 56 is formed of a high heat conductivity material, such as ¼" copper plate and has a wall 57 parallel to radial wall 28 and a wall 58 parallel to radial wall 30. Walls 57 and 58 extend along the entire length of the quadrant basket 12 and are preferably integral with one another. Walls 57, 58 terminate in flanges 60 and 61, respectively. Flanges 60 and 61 are turned inwardly and abut the inner surface of peripheral wall 27. These flanges are secured to peripheral wall 27 by means of flat headed rivets, or threaded fasteners, in the same manner as flanges 31 and 32.

Two other rows of storage modules 13 are tightly fitted against one another and the outer surfaces **57*a* and 58*a* of walls 57 and 58. One additional module 13*a*** is disposed at the juncture of these latter two rows of storage modules.

Stainless steel spacer members **59*a*, 59*b*, 59*c* and 59*d* are disposed intermediate the inner surface of peripheral wall 27 and the adjacent storage module. As a result of this construction, the storage modules are firmly pressed against one another and against copper walls 28, 30, 57 and 58, assuring optimum heat conductivity from the storage modules to these walls. The copper walls 28, 30, 57 and 58 in turn transfer heat to peripheral wall 27 through their substantial contact with peripheral wall 27 at flanges 31, 32, 60 and 61. In the embodiment shown in FIG. 3, 52 storage modules 13 are provided so that a total of 52 BWR fuel elements can be stored in the cask 10**.

In accordance with the present invention, the quadrant baskets are assembled within cask 10 in the following manner. Initially, the cask is prefabricated with the cover 15 removed to expose the cylindrical chamber 26. Each of the quadrant baskets 12 is similarly preassembled. The quadrant baskets are then inserted longitudinally into chamber 26. After all of the quadrant baskets are inserted, a spreader member 62 is inserted between the opposing radial walls of two adjacent quadrant baskets 12.

Figure 8:
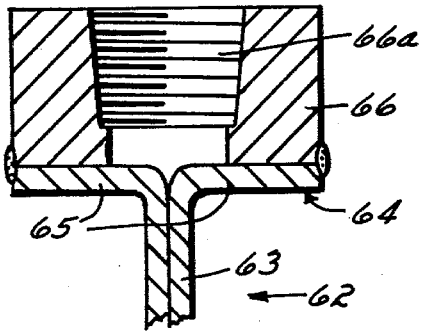
FIG. 8 is a cross-sectional view taken along line 8—8 of FIG. 7.
Figure 9:
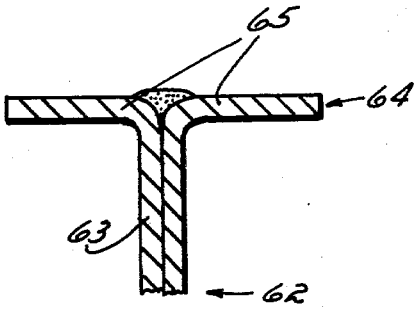
FIG. 9 is a cross-sectional view taken along line 9—9 of FIG. 7.
Figure 10:
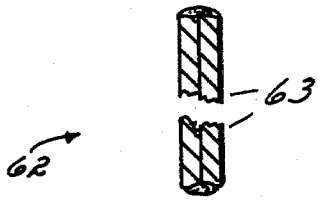
FIG. 10 is a cross-sectional view taken along line 10—10 of FIG. 7.
Figure 11:
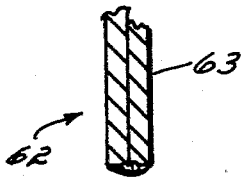
FIG. 11 is a cross-sectional view taken along line 11—11 of FIG. 7.

The spreader member 62 is illustrated in FIGS. 7–11. This member is substantially as long as the walls of the basket members 13 and is of substantial width, for example, 24". The spreader member is of T-shaped configuration including an elongated section 63 and a cross head 64. Elongated section 63 is formed of two stainless steel sheets which, in the preferred embodiment, are 18 gage. As shown in FIGS. 10 and 11, sheets are joined at their periphery by airtight welds. As illustrated in FIGS. 8 and 9, at their upper ends, the two sheets are bent outwardly to form flanges 65 which constitute cross head 64.

The flanges 65 carry a fitting 66 (FIG. 8) for connection to a fluid, e.g., air line. This fitting has a tapped opening 66*a* adapted to be connected to a source of air pressure. In use, the spreader member in its flat deflated condition is inserted between the walls of adjacent quadrant baskets 12. Thereafter, relatively low air pressure, e.g., 20 psi, is introduced into the spreader through fitting 66 to expand the spreader member forcing the quadrant baskets 12 tightly against the surrounding inner tubular member 20.

In the next step, the spreader member is deflated and removed. It is then replaced by a shim assembly 43 which permanently holds the two quadrant assemblies in firm contact with wall 20. This process is repeated by inserting the spreader member between juxtaposed walls of each pair of adjacent quadrant baskets. In each case, after the spreader member has been inserted, it is inflated to force the quadrant baskets against wall 20. It is then deflated and removed and a shim assembly 43 is inserted to hold the baskets 12 permanently in place.

Alternatively, after a separator member 63 has been expanded to shift a quadrant basket into contact with inner wall 20, the separator can be exhausted and filled with an incompressible medium, such as sand or shot. A plug is inserted in fitment 66 and the separator thereafter functions as a shim element. No additional shim elements are required.

As a further alternative for expanding the quadrant baskets in the cask cavity, other forms of separators can be employed. For example, a series of separator members in the form of elongated strips with cam surfaces can be inserted between the opposed walls of adjacent quadrant baskets. The cam surfaces are configurated so that when the elongated separator members are rotated, the quadrant baskets are forced against and into contact with the inner shell 20. Furthermore, while the cask has been described as being used to store and transport spent nuclear fuel elements, it can also be used to handle highly radioactive materials, such as consolidated spent fuel in cannisters, and solidified high level waste. These and other radioactive materials are considered within the term "fill elements" as set forth in the claims.

In order to close the cask after it has been loaded with fuel elements, a cover assembly 15 is placed over the open end of the cask. The cover assembly includes an inner cover member 67 and an outer cover plate 68. Inner cover member 67 includes a main plate 70 having an outer diameter corresponding to the inner diameter of outer shell 21 and an inner plate 71 which has an inner diameter corresponding to the inner diameter of inner tube 20. A lead body 72 fills the space between these plates.

A ring 73 is welded to the end of inner shell 20 and to the adjacent wall of shell 71. This ring is provided with a plurality, e.g., 36, of tapped openings. These openings threadably receive bolts 74 which extend inwardly through countersunk openings in plate 70. To close the cask, inner cover member 67 is first bolted to ring 73. Cover 67 carries two "O" rings (not shown) which are compressed against ring 73 to seal chamber 26. Thereafter, outer plate 68 is placed across the inner cover 67 in contact with the ends of outer shell 21. The periphery of plate 68 is preferably provided with an annular recess to receive the end of shell 21. An angle member 76 having an outwardly extending flange 77 is welded around the periphery of shell 21 adjacent to the end thereof. A similar angle member 75 with an outstanding flange 78 is welded to the periphery of plate 68.

Figure 4:
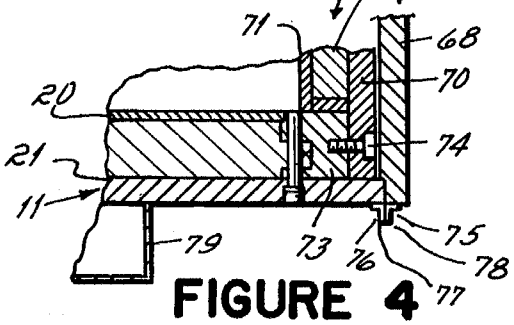
FIG. 4 is an enlarged cross-sectional view of the welded seal closure.

When the plate 68 is positioned in abutment with shell 21 as shown in FIGS. 3 and 4, the flanges 76 and 78 are in face-to-face contact with one another. The outer cover plate 68 is then welded shut by welding around the periphery of these two flanges. When it is desired to open the cask, the flanges are cut inside of the sealed weld. This allows removal of outer plate 68. Inner plate 67 is then removed by loosening bolts 74. Even after flanges 76 and 78 are cut, a sufficient portion of the flanges remains so that the cover plate is reusable, i.e., the remaining portions of the flanges can be re-welded to reseal the cask.

The cask further comprises an annular neutron shell 16. This shell comprises a tubular jacket 80 which surrounds shell 21 in concentrically spaced relationship therewith. The jacket defines a primary airtight annular fluid space 81 which extends over a major portion of the length of the cask from end wall 79 to wall 89 and a secondary airtight annular fluid space 82 of substantially smaller volume disposed adjacent to the bottom end of the cask chamber 82 extends from wall 89 to end wall 99. As best seen in FIG. 1, primary chamber 81 and secondary chamber 82 are connected through a siphon tube 83. This tube communicates with the innermost portion of chamber 81 adjacent to wall 79 and with a diametrically opposite portion of chamber 82 adjacent to wall 99.

In practice, primary chamber 81 is filled with a neutron-absorbing fluid. In the event that the volume of this fluid expands due to a temperature rise, the excess fluid flows through the siphon into secondary chamber 82. If, on the other hand, the volume of fluid in primary chamber 81 decreases due to a drop in temperature, fluid is siphoned through tube 83 from chamber 82 back into chamber 81 so that that primary chamber at all times remains filled.

Handling of the cask is facilitated by the provision of a plurality of removable trunnion assemblies 17. Each of the trunnion assemblies comprises a trunnion support 90 which is mounted upon the external surface of outer shell 21. In one preferred embodiment, the trunnion support includes a flat outer surface 91 surrounded by a raised annular rim 92. The flat support surface 91 is provided with a plurality of threaded holes 93. The trunnion 94 is of cylindrical configuration and is provided with a plurality of bolt holes 95 adapted to receive bolts 96 which releasably mount the trunnion to its support.

In use, the trunnions can be mounted to selected supports and engaged by a yoke or lifting structure to enable the cask to be shifted from one position to another. After the cask has been positioned and during shipment, the trunnions are removed. This eliminates the possibility of damaging the cask by dropping it on a trunnion and forcing the trunnion into the outer shell wall.

In addition to the components described above, the cask 10 is provided with a suitable drain connection 110 and vent 111. The construction of these components constitutes no part of the present invention and is well known in the art.

While the present cask has been described as incorporating quadrant baskets adapted to hold 52 BWR fuel elements, it is to be understood that the quadrant baskets can alternatively be configurated to hold 24 PWR fuel elements or any other number if desired.

Figure 13:
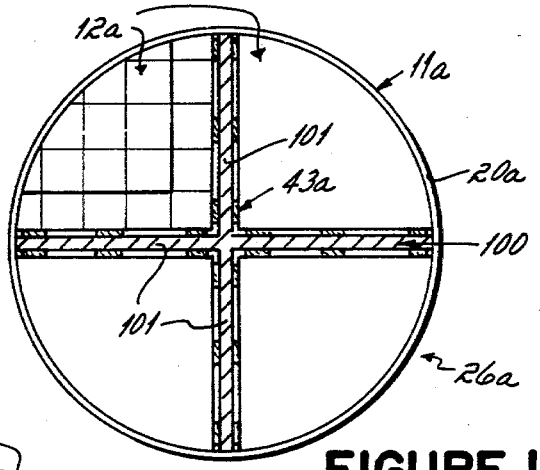
FIG. 13 is a semi-diagrammatic, transverse, cross-sectional view similar to FIG. 3 of a modified form of cask with the details of the quadrant baskets omitted for purposes of clarity.
Figure 14:
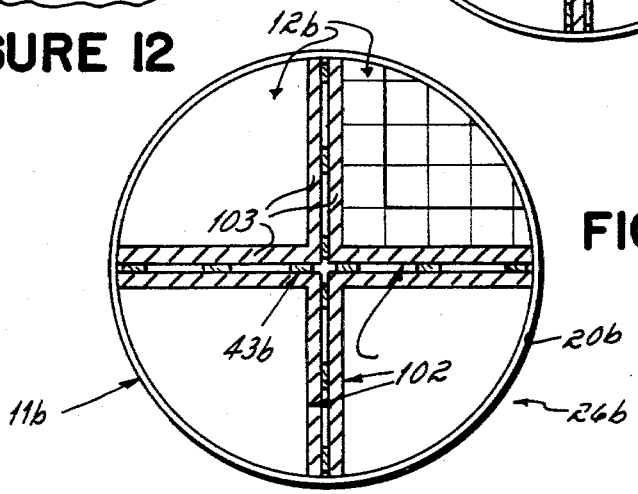
FIG. 14 is a semi-diagrammatic, transverse, cross-sectional view similar to FIG. 3 of a second modified form of cask.

Two modified embodiments of the present invention are illustrated in FIGS. 13 and 14. It is to be understood that the modifications reside in the basket and basket supporting structure and that the remainder of the cask is the same as in the preferred embodiment. As shown diagrammatically in FIG. 13, four quadrant baskets 12*a* are mounted within an inner tube 20*a*. Each of these baskets is constructed substantially like basket 12 of the preferred embodiment.

However, in the modified embodiment shown in FIG. 13, an elongated spider member 100 formed of stainless steel is inserted within chamber 26. The spider member 100 extends for substantially the length of chamber 26*a* and the four arms 101 of the spider divide the chamber into four quadrants. In this embodiment, the quadrant baskets 12*a* are urged against the inner tube 20*a* by means of shim assemblies 43*a* inserted between the arms 101 of the spider and the radial walls of the basket assemblies. The shim assemblies 43*a* are substantially identical with shim assemblies 43 described in connection with the preferred embodiment. It is further to be understood that in the assembly of the cask, the quadrant baskets are initially forced against wall 20*a* by inserting spreader members 62 between the adjacent arm 101 of the spider and the opposed wall of the basket assembly.

The second modified embodiment is shown in FIG. 14. Again, it is to be understood that the only differences between this embodiment and the preferred embodiment reside in the mounting of the quadrant baskets within chamber 26. All other elements of the cask are substantially identical with the corresponding elements of the preferred embodiment.

As shown in FIG. 14, four quadrant baskets 12*b* are mounted within inner tube 20*b*. Each of the baskets 12*b* is substantially identical with the baskets 12 of the preferred embodiment. In the modification shown in FIG. 14, in addition to the baskets, four elongated angle members 102 are inserted into cavity 26*b*. Each of the angle members comprises two radially extending arms 103 disposed at right angles to one another. These elements extend for substantially the length of chamber 26*b* and collectively divide that chamber into four quadrants. As shown in FIG. 14, the four quadrant baskets 12*b* are urged against inner tube 20*b* by means of four shim assemblies 43*b*. Each of the shim assemblies 43*b* is substantially identical with shim assembly 43 and is inserted between two opposed arms 103 of adjacent angle members 102. It is also to be understood that the quadrant baskets 12*b* are initially forced into contact with wall 12*b* by the insertion of spreader members similar to spreader members 62 between opposed arms 103 of adjacent angle members 102.

From the above disclosure of the general principles of the present invention and the preceding detailed description of a preferred and two alternate embodiments, those skilled in the art will readily comprehend the various modifications to which the present invention is susceptible. Therefore, I desire to be limited only by the scope of the following claims.

Having described our invention, I claim:

1. A cask for transporting and storing spent nuclear fuel elements, comprising:

a tubular outer shell;

an inner shell concentric with the outer shell;

a gamma radiation-attenuating material disposed between said outer shell and inner shells;

a plurality of basket members disposed within said inner shell, each of said basket members comprising radial walls and a circumferential wall formed of a thermal conducting material, said radial walls being connected at their outer ends to said circumferential wall;

a plurality of open, elongated fuel-receiving modules disposed within said baskets, at least some of said modules being in contact with said radial walls; and means urging the circumferential walls of said baskets into contact with said inner shell, said means comprising shim elements disposed intermediate opposed radial walls of adjacent basket members.

2. The cask of claim 1 in which each of said basket member is in the shape of a quadrant.

3. The cask of claim 2 in which the radial walls are provided with flanges which lap said circumferential wall.

4. The cask of claim 3 in which said flanges are connected to said circumferential wall.

5. The cask of claim 3 in which each of said basket members further comprises an inner quadrantal member formed of thermal conducting material, said member contacting at least some of said modules and said circumferential wall.

6. The cask of claim 5 in which said quadrantal member includes radial walls having flanges formed on the ends thereof, said flanges being in lapping relationship with said circumferential wall.

7. The cask of claim 6 in which the flanges of said quadrantal member are secured to said circumferential wall.

8. The cask of claim 1 further including trunnion-mounting means carried by said outer shell and trunnions removably secured to said trunnion-mounting means.

9. The cask of claim 1 further comprising:

an outer cover member, a first peripheral flange on said cover member;

a second peripheral flange on said outer member, said first and second flanges being disposed in facial abutment when said outer cover is in position to close said cask, and a peripheral weld securing said flanges together to form a leak-tight containment.

10. The cask of claim 9 further comprising an inner cover disposed within the end of said outer shell, a ring secured to said outer shell, bolt means securing said inner cover in closed position to said ring, and means sealing the inner cover to said ring.

11. The cask of claim 1 in which said fuel-receiving modules are formed from a neutron-attenuating material.

12. The cask of claim 1 further comprising a primary chamber surrounding said outer shell and a neutron-attenuating material disposed within said chamber.

13. The cask of claim 12 in which the primary chamber is a fluid chamber; and the cask further comprises:

a secondary fluid chamber surrounding said outer shell, said secondary chamber being substantially smaller than said primary chamber and being disposed adjacent to one end of said cask;

a siphon tube interconnecting said primary and secondary chambers, whereby said primary chamber remains filled with fluid despite temperature changes.

14. The cask of claim 13 in which each siphon tube communicates with said secondary chamber at a first point and with said primary chamber at a second point diametrically opposite and adjacent the opposite end of said cask.

15. The cask of claim 2 in which said shim elements comprise a plurality of spaced elongated strips and means extending between said strips to hold said strips in spaced relationship.

16. The cask of claim 2 in which said shim elements comprise a hollow member filled with an incompressible medium.

17. The method of assembling a cask for transporting and storing spent nuclear fuel elements, comprising the steps of fabricating a cask body including a tubular outer shell, an inner shell concentric with the outer shell and a gamma radiation-attenuating material disposed between said outer shell and said inner tube;

fabricating a plurality of basket members, each of said basket members comprising radial walls and a circumferential wall, said radial walls being connected at their outer ends to said circumferential wall, and a plurality of open, elongated fuel-receiving modules disposed within said basket members, at least some of said modules being in contact with said radial walls;

inserting said basket members within said inner shell;

inserting expansible separating means between opposite walls of adjacent basket members;

expanding said separating means to force said basket member circumferential walls into contact with said inner shell; and providing shim means between said opposed walls to maintain said basket members in contact with said inner shell.

18. The method of claim 17 in which said basket members are of quadrant shape and four of said basket members are inserted in said inner tube.

19. The method of claim 18 further including the steps of assembling a cover with said cask by welding a reusable peripheral flange on said cover to a mating reusable peripheral flange on said outer shell.

* * * * *